US007366634B2

(12) United States Patent
Pacheco

(10) Patent No.: US 7,366,634 B2
(45) Date of Patent: Apr. 29, 2008

(54) GANTRY WITH AUTO-ADJUSTING PRESTRESSING

(76) Inventor: Pedro Álvares Ribeiro do Carmo Pacheco, DEC, Fac. Engenharia UP, Rua Dr. Roberto Frias s.n, 4200-465 Porto (PT)

( * ) Notice: Subject to any disclaimer, the term of this patent is extended or adjusted under 35 U.S.C. 154(b) by 213 days.

(21) Appl. No.: 10/559,722

(22) PCT Filed: Jun. 3, 2004

(86) PCT No.: PCT/PT2004/000011

§ 371 (c)(1),
(2), (4) Date: Dec. 5, 2005

(87) PCT Pub. No.: WO2004/109018

PCT Pub. Date: Dec. 16, 2004

(65) Prior Publication Data

US 2006/0174427 A1 Aug. 10, 2006

(30) Foreign Application Priority Data

Jun. 6, 2003 (PT) ..... 102968N

(51) Int. Cl.
*G01C 9/00* (2006.01)

(52) U.S. Cl. ..... 702/150; 702/41; 702/43; 702/173; 702/174; 405/218; 405/224

(58) Field of Classification Search ..... 702/150, 702/173, 174, 41, 43; 414/138.1–138.3, 414/139.6–139.8; 405/219, 214, 224, 218
See application file for complete search history.

(56) References Cited

U.S. PATENT DOCUMENTS 5,154,561 A * 10/1992 Lee ..... 414/138.3
6,802,684 B2 * 10/2004 Arntzen et al. ..... 414/140.3

FOREIGN PATENT DOCUMENTS

DE 1 101 477 3/1961
GB 2 073 296 A 3/1980
WO WO 00/68508 11/2000

OTHER PUBLICATIONS

International Search Report Feb. 14, 2005.

* cited by examiner

*Primary Examiner*—John Barlow
*Assistant Examiner*—Hien Vo
(74) *Attorney, Agent, or Firm*—Joseph T. Guy; Nexsen Pruet, LLC

(57) ABSTRACT

A gantry to be used in the construction process of bridges, viaducts and other structures, which is equipped with a system that automatically adjusts the prestressing of the gantry's structure in accordance to the external actions being applied on it when loadings occur. The adjustment of the prestressing is achieved through the use of at least one sensor (2) that monitors the structure and which sends the measurements taken to a controller (6), . This controller is then capable of activating at least one actuator which alters the tension of the structure's prestressing cable or cables. Amongst the many advantages of the present invention, one is the possibility of applying a large amount of prestressing without this implying undesirable deformations in the main structure (1) when exterior loads are not applied.

9 Claims, 8 Drawing Sheets

GANTRY WITH AUTO-ADJUSTING PRESTRESSING

TECHNICAL FIELD

This invention relates to a gantry for use in construction, and more specifically to a gantry equipped with a system that automatically adjusts it's prestressing.

BACKGROUND ART

In modern civil engineering, the use of gantries (overslung and underslung) in the construction of bridges and viaducts has largely overtaken ground resting scaffolding. However, the factor that hinders their more generalized use is the fact that they represent a large investment in terms of materials and construction labour. Although present gantries are reusable, it is also very common for them to require re-adaptation, in particular when the project calls for it to carry more load then it was initially designed for. This adaptation is in itself a very time consuming and expensive process which normally delays the pace of construction.

The use of prior art gantries also implies some considerable risk. This is because they are structures that are meant to support a great deal of permanent and variable loads and can lead to a great deal of deformations and stresses that weaken the structure and may eventually lead to its collapse. Several accidents have occurred in the past.

The use of cables or tendons with adjustable prestressing have been used in the past to strengthen and reinforce concrete girders as can be seen in the patent applications WO 00/68508 (Interconstec Co. Ltd), WO 02/28168 (Interconstec Co. Ltd) and WO 01/27406. However, these structures required the introduction of external tools to increase or decrease the tension of the cables. The adjustment was also not made in response so the loads applied to the structure at any given time, but was rather included in a strategy of periodic maintenance of the girders.

OBJECT OF THE INVENTION

It is the primary object of the present invention to provide a gantry with an automatic or semi-automatic system of adjusting the prestressing of the gantry's structure in accordance to the external actions being applied on it when loadings occure.

It is a further object of the present invention to provide a more structurally efficient gantry than ones of the prior art, more specifically one that possesses a system capable of countering deformations and stresses in the structure of the gantry immediately after detecting them, thus ensuring a compensation that guarantees an adequate structural perfomance.

It is still a further object of the present invention to provide a gantry that is capable of supporting more load than a prior art gantry of equivalent size and structural mass.

Finally, it is an additional object of the present invention to provide a system which is able to be used for strenghtening different old or new launching gantries units.

DISCLOSURE OF THE INVENTION

According to its broadest aspect, the present invention provides a gantry for use in the construction process of bridges, viaducts and other structures, said gantry comprising: a main load bearing structure; at least one unbonded cable; a first anchorage for securing one end of said unbonded cable to the said structure and a second anchorage for securing the opposite end of said unbonded cable to the said structure; characterized in that there is provided at least one sensor capable of measuring a physical variation in said main structure, an electronic interface converting said measurements into readable data and transmitting said data to a controller; said controller being capable of activating an actuator which rests between said structure and said unbonded cable and which is capable of increasing or decreasing the tension of said unbonded cable in accordance to the measurements taken.

The said unbonded cable can be either internal or external to the contours of the said main structure and may assume a linear or multi-linear layout. In the event of there being more than one cable, there may be a mixture of internal and external cables, whose ends are individually secured by specific anchorages, those anchorages being conected to structural elements which may secure more than one anchorage. Those structural elements are common stiffened plates. Generally, the only restriction is that the cable's layout should not come into conflict with neither the structure nor the construction process.

As mentioned above, the main structure is monitored by at least one sensor, located either in the neighbourhood, surface or interior of an element of the gantry or may even be external to the main structure. In general terms, the location of the sensor or sensors is not important so long as they can accurately measure any predefined physical variations on the main structure when it is in use.

The measurements that are useful for the calculation of the intensity and/or direction of the forces to be applied by the actuator, may be, for example, displacements, rotations, deformations, load levels, tensions, extensions or pressures. The gantry is also preferably equipped with one or more auxiliary sensors for measuring temperatures and eventually for measuring velocities or accelerations. Many types of sensors achieve reasonable results, by way of example the sensor or sensors can be a pressure transducer, an extensometer, a LVDT, a laser sensor or a charge cell. The sensors may be directly connected to the controller or through an interface circuit which may include amplifier filtering or converting devices. Preferably, some transducers are used with standard ouputs (e.g. 4-20 mA) thus not requiring any additional interface elements.

The transmission of data or signals in the present invention can be achieved either by a physical connection or wireless technology, more specifically through electric wiring, optic fiber communication, radio frequency or infrared, Wi-Fi or Bluetooth™ technology. In the event of wireless technology being used to transfer data or signals between the sensor(s) and controller and between controller and actuator(s), it is necessary to provide these said elements with corresponding transmitters and receivers of said data.

The aforementioned controller of the present invention comprises at least one computer or automaton capable of running at least a software program or processing code. Said software program or processing code is capable of receiving the data from said or each sensor, processing the said data received from the said or each sensor and transmitting the processed data in the form of instructing signals to at least one actuator. These instructing signals activate the actuator or actuators leading them to accurately increase or decrease the tension of the unbonded cable. Preferably, the said software or processing code of the said controller contains at least three sub-programs, namely a Test Program, a Loading Program and an Unloading Program. The Test Program incorporates a basic algorithm used to directly promote the stretching and relaxing the cables, and in doing so, permit the performance of calibration and maintenance tests. The Loading Program incorporates an algorithm that reflects the control strategy that will be adopted for the specific gantry in question in the loading phase (for example during concrete filling). The Unloading Program incorporates an algorithm that reflects the return of the actuator to its resting position (to be used, for example, when the bridge deck prestressing is applied).

As mentioned above, upon receiving the instructing signals from the controller, the movement of the actuator or actuators are promoted. The said instructing signals promote the actuator or actuators to apply a specific intensity of force and/or its respective direction. Therefore, the actuator or actuators is/are responsible for altering the tension of the unbonded cable or cables and thus adjusting the prestressing of the main structure. As will be obvious to those skilled in the art, the increase or decrease of the tension of the cable will/should be in accordance with the necessity of counteracting the internal forces generated in the structure by the external actions. In the event of there being more than one cable, the tension of the said cables may be tensioned or relaxed in unison or independently of each other. This characteristic enables the prestressing to be adjusted in specific parts of the main structure.

In another less favoured embodiment of the invention, the controller may be a human operator in control of an electronic control board capable of activating the actuator or actuators. In this embodiment, the human operator receives the data transmitted from the said sensor or sensors and interprets it. Depending on the readings, the human operator then promotes the movement of the actuator or actuators in order to introduce self-equilibrating forces on the main structure. This semi-automatic adjustment of the prestressing in the structure is less precise than the fully automatic controller and hence less safe and reliable. It also calls for a human operator to be permanently controlling the actuator or actuators during periods of time that reach several hours, for example, during the concrete filling of a bridge deck.

It should also be noted that the present invention also contemplates the equipping of pre-existing gantries with an automatic adjusting prestressing system. This method is achieved by equipping the pre-existent gantry with the essential elements and system of the invention mentioned above.

The great advantage of the present invention is that it provides the possibility to apply large amount of prestressing without implying undesirable deformations in the main structure when exterior loads are not applied. If such an amount of prestressing was applied using prior art "fixed" prestressing, without exterior loading applied, the main structure would break "up side down". Besides that, the present invention provides a substantial reduction in prestressing losses.

A gantry with auto-adjusting prestressing has very reduced mid-span deflections, because adjusting prestressing compensates the main loading. Although prestressing introduces compression stresses, for the same reason stated before, flexural moments on the main structure are substantially reduced thus reducing maximum stresses in the main structure members. Thus the structural elements sections may be significantly reduced providing a much lighter and functional gantry.

Additionally, the gantry is also economically more efficient than the present prior art because it permits far more reuse of a single gantry. As will be evident from this patent specification, a gantry with automatic adjustable prestressing can be used in many more situations than prior art gantries due to its adaptability to a far greater number of load level ranges (or span ranges) without requiring substantial additional reinforcements.

Another great advantage is that the structural behaviour of the gantry is under continuous monitoring and dangerous deformations or tensions caused by external actions are immediately counteracted and resolved. As redundancy is to be applied, especially with electronic components and some mechanical devices, in cases of failure of any conponent, the gantry safety is not affected.

It should be noted that the term "prestressing" as it is used herein consists in the introduction of a set of self-equilibrating forces on the structure that will counteract the internal forces generated in the structure by external actions.

BRIEF DESCRIPTION OF THE DRAWINGS

FIG. 4 shows an end of an unbonded cable anchored to the main stricture using an anchorage that is active/movable due to a hydraulic jack placed in between;

BEST MODE FOR CARRYING OUT THE INVENTION

A detailed description of the invention will now follow making reference to a particular preferred embodiment and the drawings mentioned above. The description of the embodiment and the drawings are only by way of example, and should not be interpreted as limiting the scope of the invention as defined in the attached claims.

Figure 1:
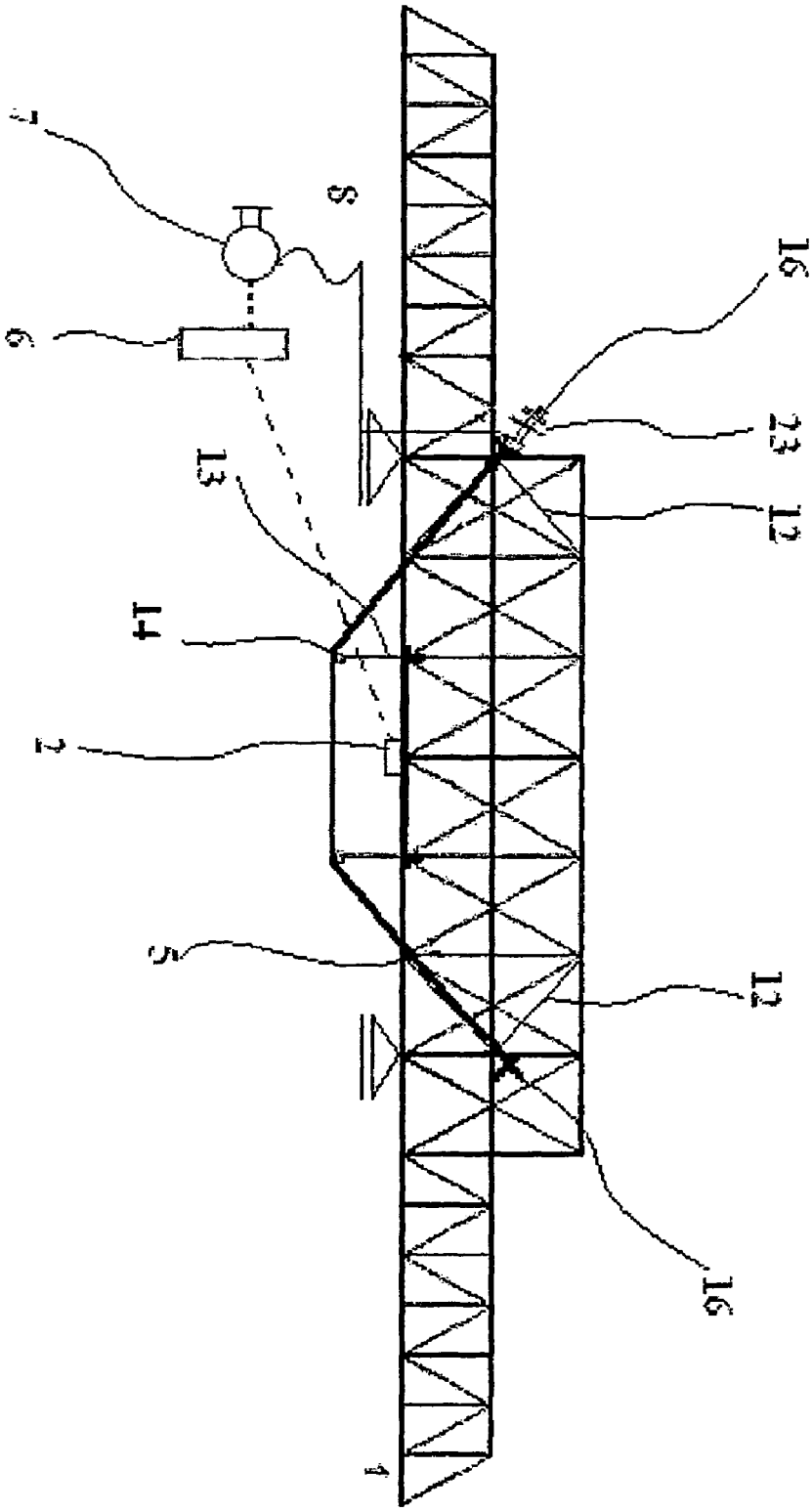
FIG. 1 shows a simplified side view of an embodiment of the present invention, in which it is possible to see the main elements that constitute the invention.
Figure 2:
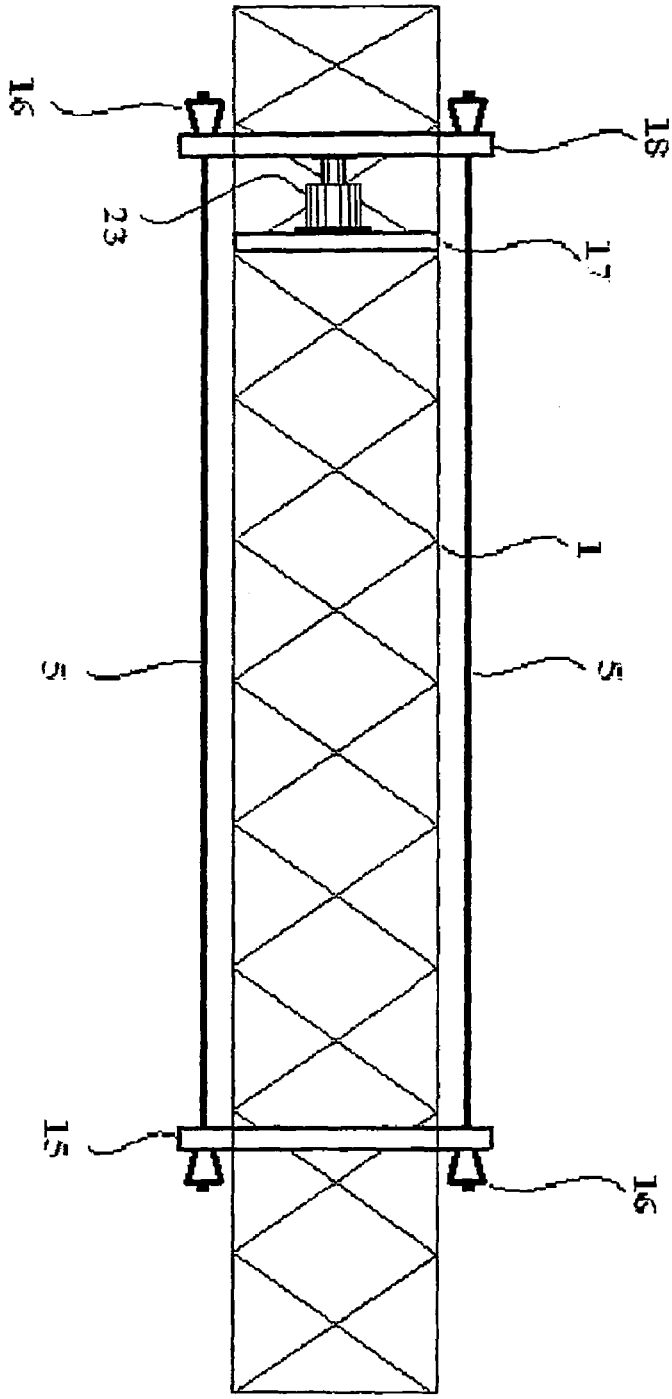
FIG. 2 is a schematic plant of the embodiment of the gantry of FIG. 1.

Making reference to FIG. 1, there is provided a gantry comprising a main structure (1) constituted by two outer sections and one middle section. The two outer sections, which are meant to facilitate launching process, are lower in height than the middle section which is intended to support formwork and main loadings. The main structure is a trussed box girder so as to assume a design similar to that illustrated in FIG. 1. The location of the supports are defined for a typical construtive technique where each concrete filling segment, having the same length of the structure's span, starts at a distance of approximately ⅕ of the span from the front support of previous segment.

Figure 10:
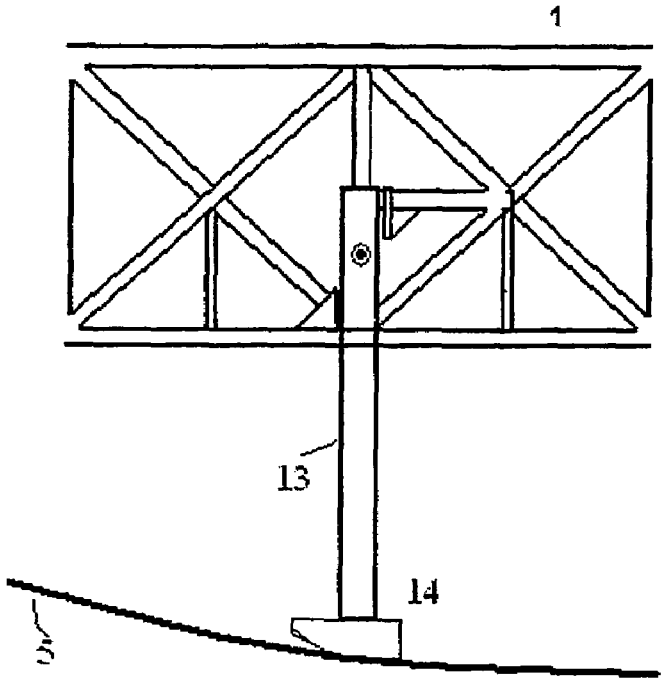
FIG. 10 shows a simplified representation of another embodiment of a movable strut and deviation saddle system (movable by rotation).

The main structure (1) is equipped with two external cables (5), one on each longitudinal side of the said structure. The cables must, for obvious reasons, be unbonded and may be either mono-strands or multi-strands. The unbonded cables may be set up with plastic pipes filled with grease or according to other prior art solutions. The eccentricity of each said external cable (5) is achieved by two spaced external deviation saddles (14) supported by two corresponding connecting struts (13). Each said connecting strut (13) has a first end coupled to a single deviation saddle (14) and a second connected to the said main structure (1). Said connecting struts (13) are preferably retractable (by rotation) or extendable, in order to facilitate launching process (see FIG. 10).

Figure 3:
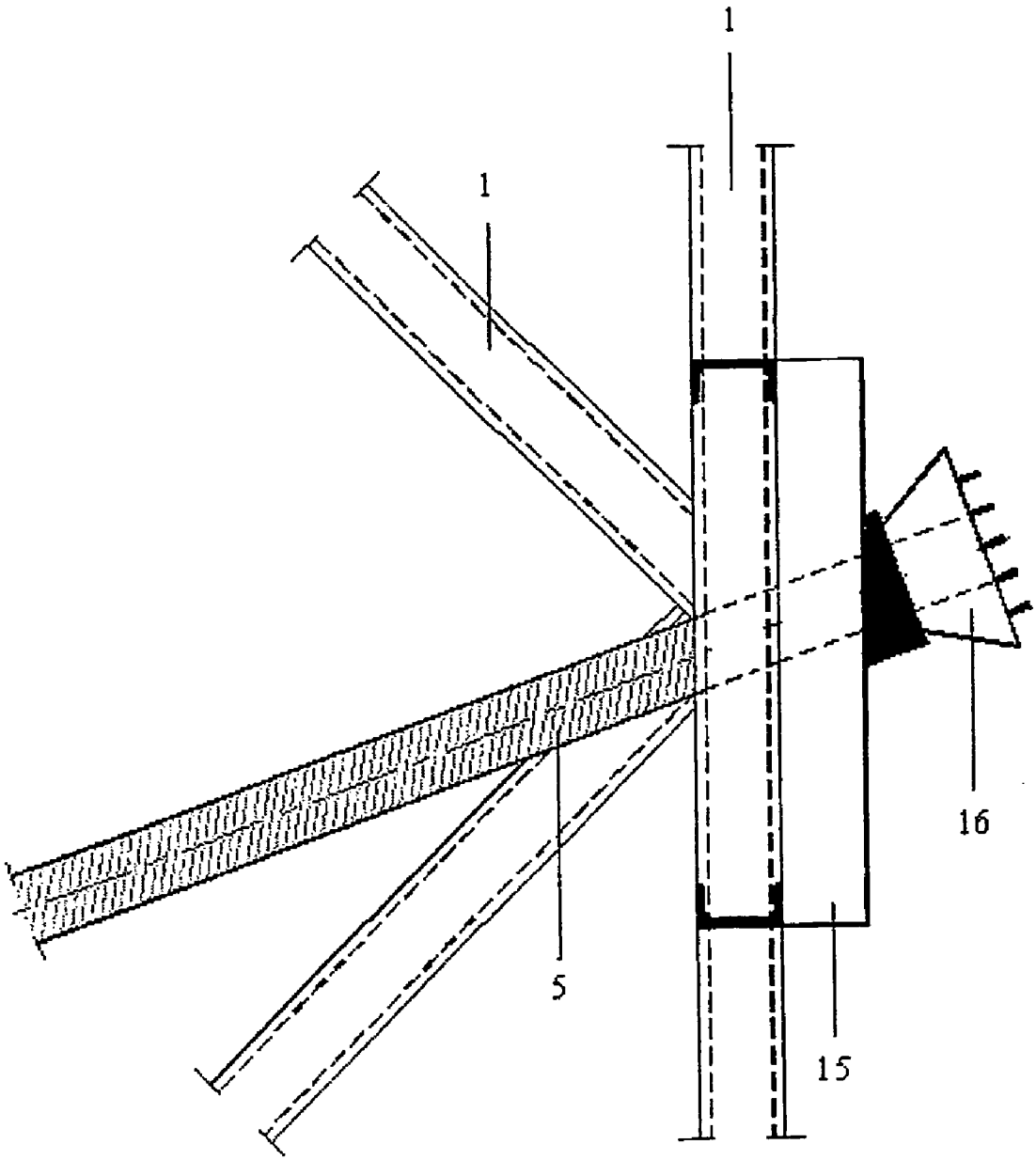
FIG. 3 shows an end of an unbonded cable anchored to the main structure using an anchorage that is passive/non-movable.

Each end of both cables (5) is secured to the said main structure (1) by means of two anchorages. The first ends of both external cables (5) are secured to the main structure by means of fixed or "passive" prior art anchorages. Reporting to FIG. 3, these anchorages are comprised of prior art anchorages heads (16) that are fixed to strength plates (15) permanently connected to the main structure (1). The opposite ends of both said cables (5) are attached to a moveable anchorage of the present invention.

Figure 4:
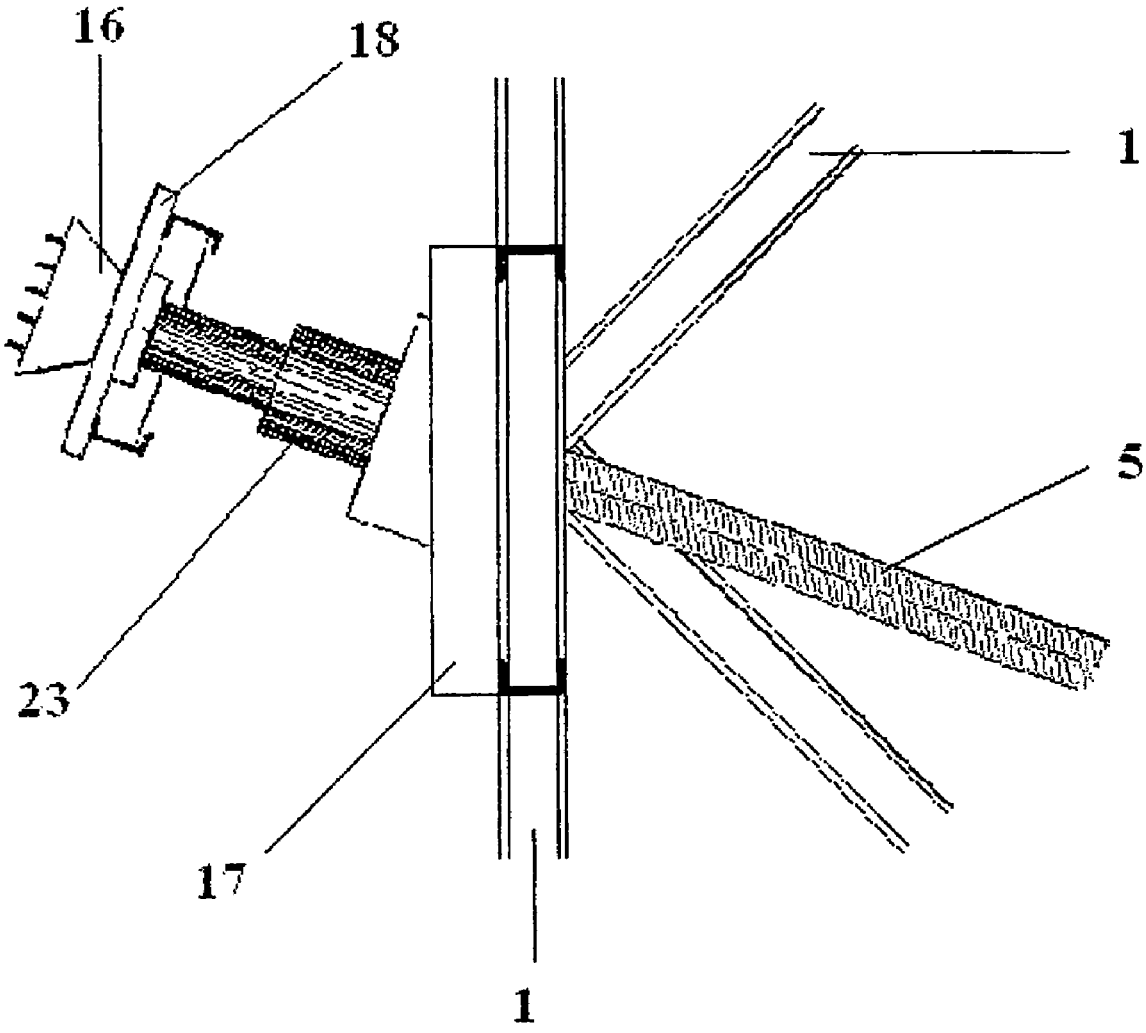

Reporting to FIG. 4, the moveable anchorage of the present embodiment comprises of a prior art anchorage head (16) that is fixed to a strength plate (18) attached to one hydraulic jack (23). Said hydraulic jack is fixed to a strength reaction plate (17) that is permanently connected to the main structure (1).

It should be stressed that a variety of other embodiments are possible, for example, the reaction plate (17) could have two hydraulic jacks installed on the sides and the cables in the middle section, or if the number of cables is equal to the number of actuators, they might pass through them (prior art hollow cilinders).

The movement of the hydraulic jack's (23) piston which may be done by elementar strokes, pushing plate (18) and the anchorage head (16) away from the main structure (1) has the effect of tensioning the cable or cables of the gantry and increasing the level of prestressing in the strucutre. Conversely, the approaching of the plate (18) and anchorage head (16) towards the main structure (1) would have the effect of relaxing of the cable or cables of the gantry and therefore reducing the level of prestressing in the structure. The movement of the hydraulic jack's (23) piston is achieved by a hydraulic circuit and energy supply that will be discussed further below. The intensity of the force that should be applied by the hydraulic jack (23) on the plate (18), related with the number of strokes advanced by the piston, is in accordance with the processed signals received from the controller, these said signals being in turn based upon the measurements of the sensor or sensors. It should be noted that both moveable and passive anchorages are designed to enable the cables to be released should there be a necessity in substituting them or transporting the structure.

Figure 9:
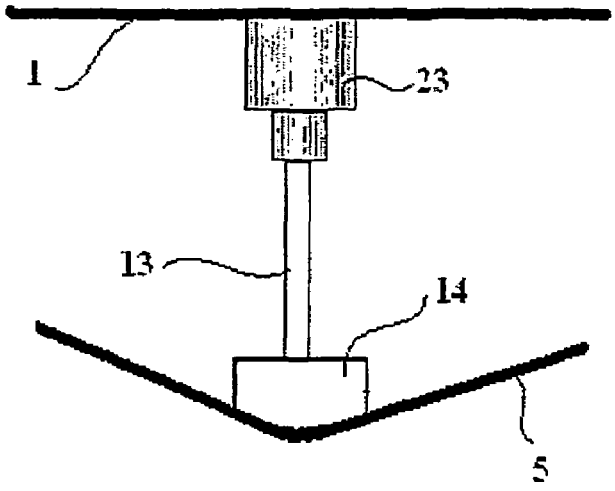
FIG. 9 shows simplified representation of an extendable connecting strut and deviation saddle.

Alternatively, refering to FIG. 9, the tensioning and relaxing of the said unbonded cables (5) can also be achieved by the movement of extendable struts (13) if hydraulic jacks are located between the main structure (1) and deviation saddles (14). With this embodiment, the extending of the hydraulic jack's piston forces the corresponding deviation saddle (14) away from the main structure (1). Through this action, the cable connected to the deviation saddle is tensioned bringing about an increase in the prestressing of the structure. In this case the actuator would increase force and eccentricity at the same time.

Figure 7:
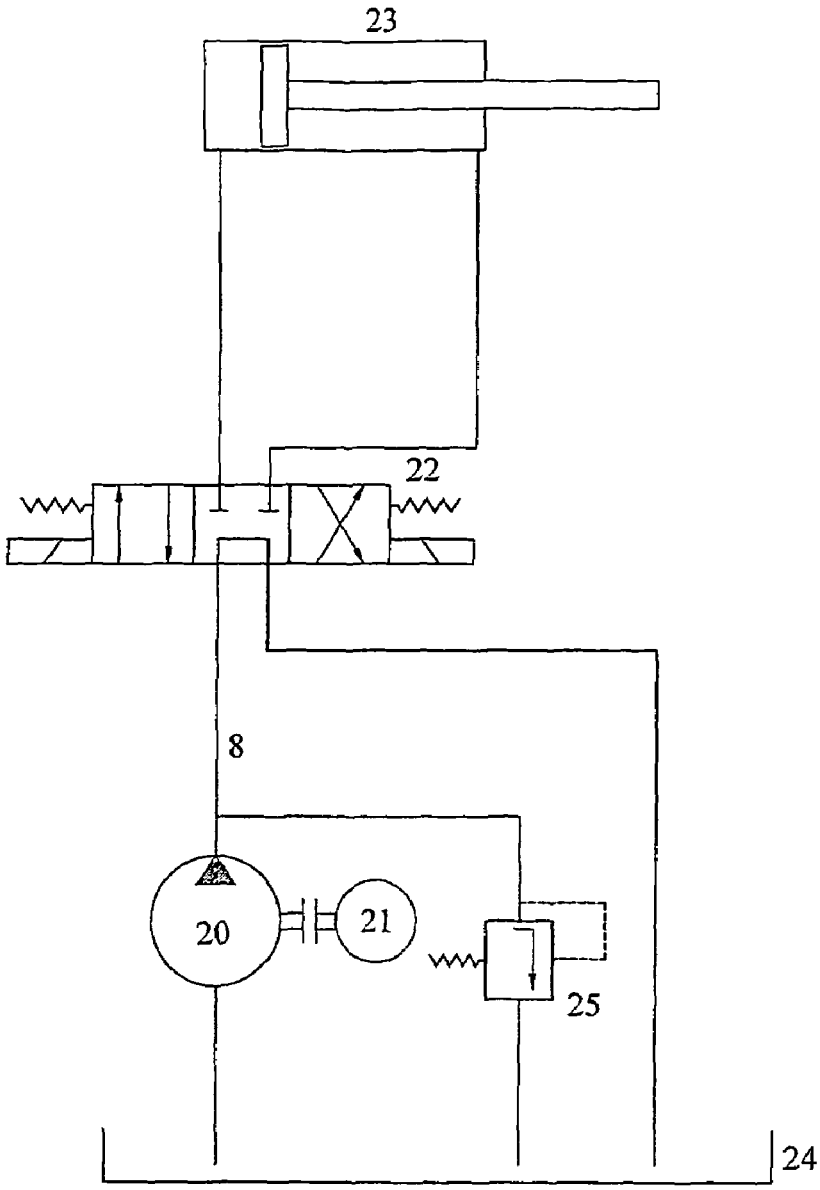
FIG. 7 shows a simplified representation of the hydraulic circuit.

The hydraulic circuit of the actuator may be similar to that represented in FIG. 7. Said hydraulic circuit includes a hydraulic pump (20) and the respective motor (21), connected to some directional valves (22), some pressure limiting valves (25) and a reservoir (24). The directional valves (22) are in turn connected through some pipes or tubes (8) to the hydraulic jack or jacks (23). The instructing signals from the controller activate the electric motor (21) that promotes the flow of oil or similar fluid in the pipes (8). The instructing signals also promote the movement of the directional valves (22) in order to alter the direction of the flow of oil or similar fluid. The design and installation of the hydraulic system is made according to common techniques and using known technology adequate for the objective. In the event of more than one actuator (e.g more than one jack), the design of the hydraulic system is adapted accordingly. It is essential that the combination of hydraulic circuit and jacks do not act in an excessively rapid manner for this could compromise the integrity of the structure. The said motor is preferably an electric motor, although other options are equally suitable.

The requirements that hydraulic system must have are:

(i) maximum force on each hydraulic jack equals the prestressing force that it has to produce;

(ii) maximum course of each piston corresponds to the stretching of the cables that produce the maximum prestressing force plus the course necessary to compensate prestressing loses plus a constructive course to facilitate the cables assembling;

(iii) minimum velocity of each piston is such that the response period of the system is equal or inferior to the corresponding loading period;

(iv) maximum velocity of the piston is such that the $\alpha$ factor (dynamic amplification factor) doesn't imply the system's instability—see Equation 2 below, unless other measures are taken to avoid dynamic problems;

(v) minimum pressure in each piston is such that its dimensions are geometrically compatible with its insertion on the gantry.

Figure 8:
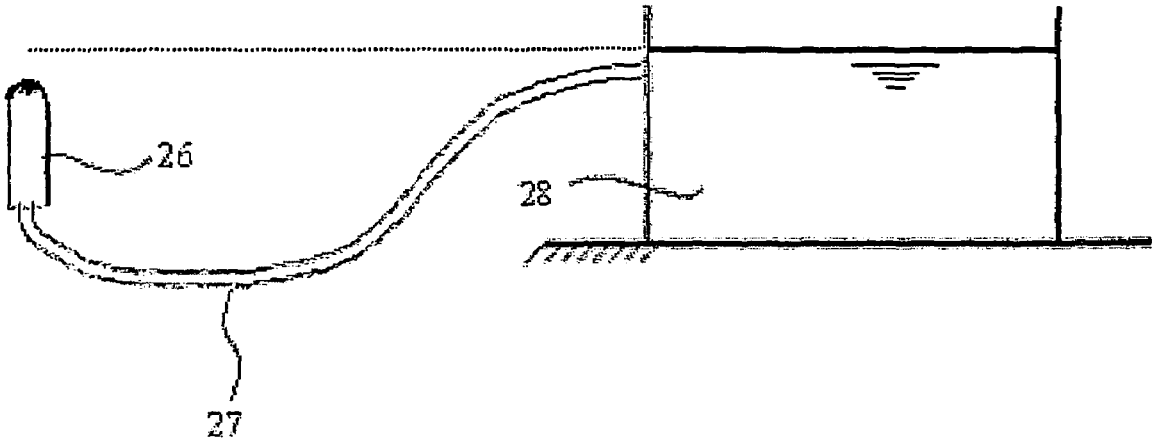
FIG. 8 shows a schematic representation of a fluid circuit wherein a pressure transducer is introduced.

In order to materialise the automatism of the adjustable prestressing system described above the gantry of the invention is also equipped at least one sensor for monitoring the structural behaviour of the main structure (1). In a preferred embodiment, the main structure (1) is fitted with a sensor preferably located in an area near the mid-span of the lower under surface of the said structure (1). This sensor is, for example, an extensometer glued to a profile in the controlled section, which would allow to measure extension variations, and subsequently tension variations. The main structure (1) may be also preferably equipped with a pressure transducer placed at half span of the gantry which would permit the measuring of pressure and therefore altimetric variations of level. Reporting to FIG. 8, this is a very simple measurement strategy based on the static pressure difference between the fluid level in a fluid reservoir (28) located at a fixed position (for example, over one column) and an adequate pressure transducer (26) located at mid-span of the launching girder (1), with a flexible fluid line as interconnection (27). Any deformation of the main structure is measured as a pressure variation on the pressure sensor. This value is only affected by vertical movements and is insensitive to lateral movements or compression phenomena on the structure.

Naturally, the greater number of sensors the greater perception of the external and internal forces acting upon the main structure (1) and hence a clearer picture of the structural behaviour at any given time. For example, it would be advantageous to have extensometers attached to several truss elements and the hydraulic jack piston's position verified by means of a LVDT sensor. However, not neglecting redundancy, the system becomes simpler if only one measure is considered in the main control algorithm. The complementary sensor or sensors, which can be installed in the neighbourhood, surface or interior of the elements of the gantry or even externally in relation to the main structure (1), are capable of producing data which would be sent to the controller either through physical connection or through wireless transmission, only to provide redundancy. The current output signal of each sensor must take into account immunity to thermal variations and electromagnetic fields, especially in cases where the transducer is located several tenths of meters away from the controller.

As mentioned above, the controller (6) of the present invention comprises at least a computer or automaton (for example a PLC) that comprises a computer software program or processing code. This computer software comprises a reception phase of data from the said sensor or sensors (2); a processing phase for processing the said data received from the said sensor or sensors (2); and a transmission phase for transmitting the processed data or instructing signals to an actuator or actuators. It should be noted that the distance between the said sensor or sensors (2) and the controller (6) is not a limitative feature.

The development of the said computer software program or processing code is done according to well known computing techniques, in a language compatible with the computer or automaton used. The purpose of the said program or processing code is to provide control strategies for the automatic control of the adjustable prestressing system.

In general terms, one of the following control strategies will be adopted:

a) Control of tensions of half span inferior section (control section);

b) Control of the gantry mid-span deflection

The control strategy (a) developed translates into a simple algorithm, similar to the classic "on-off". Basically, for a gantry with only one actuator, if the traction increases on the control section, the hydraulic jack's piston advances a predefined stroke (moving away from main structure (1) i.e. the prestressing forces are amplified. On the other hand, if traction decreases, the hydraulic jack's (23) retracts a predefined stroke (approaching to main structure) (1) i.e. prestressing forces are reduced.

Figure 5:
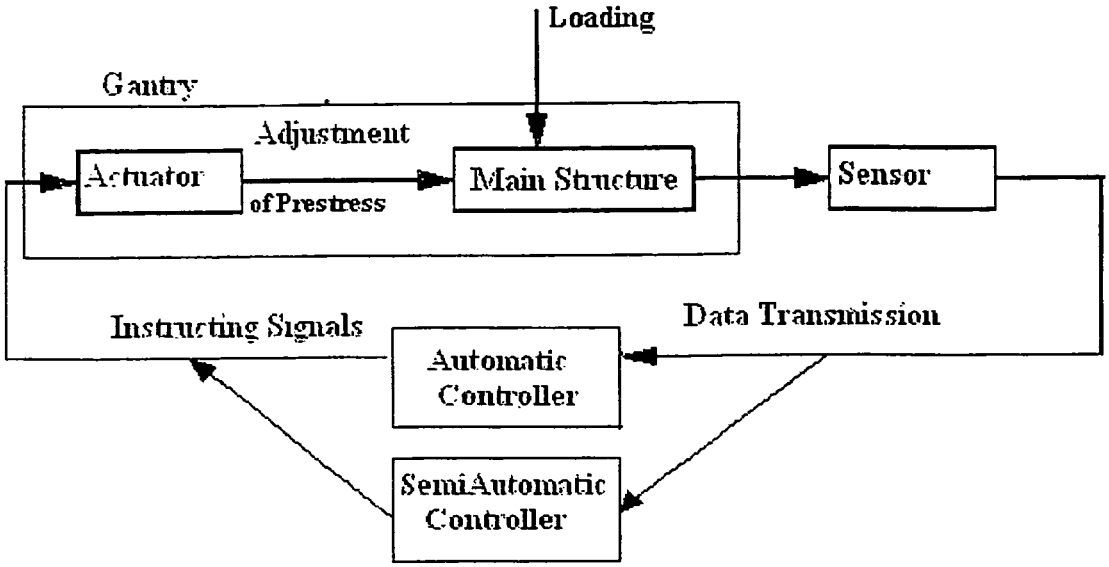
FIG. 5 shows a schematic flow diagram of a possible automatic control process of the present invention.
Figure 6:
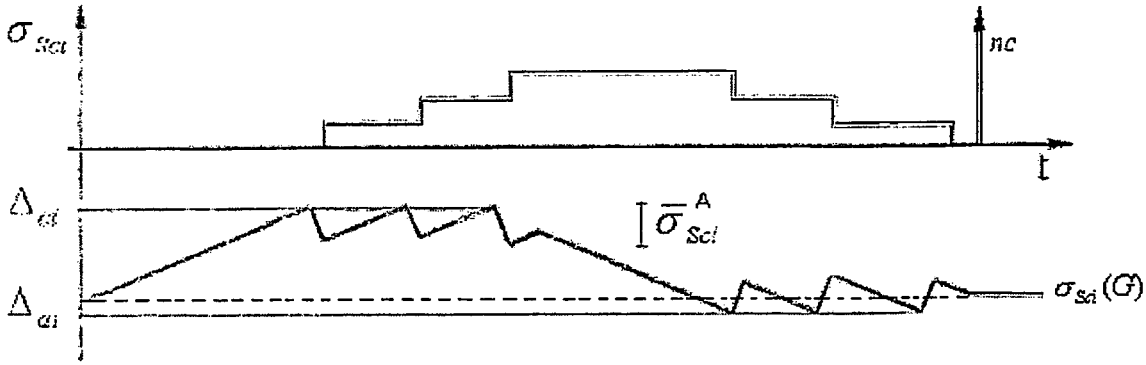
FIG. 6 shows a diagram of a possible implementation of the control algorithm of the present invention.

The algorithm described above is illustrated in the graph of FIG. 5. This algorithm can also be put into the following mathematical equation:

Equation (1)

$$\begin{cases} \Delta_{ai} < \sigma_{Sci}(G) + \sigma^{t}_{Sci}(Q) + nc_t \times \overline{\sigma}^{A}_{Sci} < \Delta_{ci} & \Rightarrow \quad nc_{t+\Delta t} = nc_t \\ \sigma_{Sci}(G) + \sigma^{t}_{Sci}(Q) + nc_t \times \overline{\sigma}^{A}_{Sci} > \Delta_{ci} & \Rightarrow \quad nc_{t+\Delta t} = nc_t + 1 \\ \sigma_{Sci}(G) + \sigma^{t}_{Sci}(Q) + nc_t \times \overline{\sigma}^{A}_{Sci} < \Delta_{ai} & \Rightarrow \quad nc_{t+\Delta t} = nc_t - 1 \end{cases}$$

in which, $\sigma_{Sci}(G)$ is the stress at the relevant fibre in control cross section i due to dead loading;

$\sigma^{t}_{Sci}(Q)$ is the stress at the relevant fibre in control cross section i due to live loading at instant t;

$\overline{\sigma}_{Sci}^{A}$ is the stress increment at the relevant fibre control cross section i produced in one hydraulic jack stroke;

$nc_t$e $nc_{t+\Delta t}$ are the number of strokes advanced at instants t and t+Δ6.

$nc_t \times \overline{\sigma}_{Sci}^{A}$ is the stress at the relevant fibre in control cross section i due to action of the auto-adjustable prestressing at instant t; $\Delta_{ci}$e $\Delta_{ai}$ are the compression margin and the activity margin of the adjustable system (these are the stress levels that make the sensors produce signals);

The adoption of this kind of algorithm should be followed by measures of fixing of the control's settings in order to avoid instability.

Typically the loadings of gantries take place very slowly, for example the concrete filling of structures such as bridge decks can take several hours. Thus it is particularly easy to avoid the dynamic amplification effect. All that is necessary is to ensure that the time period of each stroke is several times longer than the natural vibration period of the main structure (1). Nevertheless, the dynamic amplification should be quantified and should verify the following condition:

$$|\overline{\sigma}_{Sci}^{A}|\cdot\alpha < |\Delta_{ai} - \Delta_{ci}| - \Sigma|\delta j| \qquad \text{Equation (2)}$$

In which α represents the factor of dynamic amplification measured during the exclusive action of the actuator on a course and δj represents each uncertainty j.

Dynamic problems may also be avoided using software filters, for example, neglecting data significantly different from average values.

In a common application of the invention, the fundamental uncertainties to consider are: the difference of tension on the control section due to an extension equal to the maximum error on the extensometer readings (δ1) and the difference of tension on the control section due to the maximum error of positioning of hydraulic jack's (23) piston during a basic trajectory movement (δ2) (this last one has in itself several uncertainties, namely the ones related with the material features of the main structure (1) and cables (5), tension losses and construction errors).

Even if the mentioned error's quantification is given (or the maximum deviations of the properties of the materials) by the equipment and material suppliers, tests should be conducted to experimentally quantify the respective values during the calibration process.

In this type of application, given the relatively long duration of loading, the response delays are, in general, disregarded.

At the same time, the following equation should be verified:

$$\sigma_{Sci}(G) - \Delta_{ai} < |\overline{\sigma}_{Sci}^{A}| - \Sigma|\delta j| \qquad \text{Equation (3)}$$

The fulfilment of this equation ensures that in the absence of load, the system returns to its original position.

The control settings fixing is made by the following way:

The increase of tension on the control section i, produced by the actuator during a piston stroke $\overline{\sigma}_{Sci}^{A}$, is defined in function of the shortest course that the hydraulic jack (23) is capable of making with acceptable precision (if the stroke is known, which is equal to the stretching of the cables, the prestressing is therefore known, and subsequently, the respective tension variation on the control section is also defined);

Once that value is known and the sum of the uncertainties is also known (function of the selected equipment and materials), one can determine $\Delta_{ai}$ using Equation 3;

The value of α is previously fixed and then confirmed through trial;

Finally, $\Delta_{ci}$ is fixed attending to Equation 2.

The control strategy (b) can be determined by an algorithm similar to that of (a). In that case, the control variable would be the mid span deflection and the sensor embodiment of FIG. 8 would be adopted. Basically, for a gantry with only one actuator, if the mid-span deflection overcomes a predefined value, the hydraulic jack's piston advances a predefined stroke (moving away from main structure (1) i.e. the prestressing forces are amplified. On the other hand, if the mid-span deflection overcomes another predefined value (the main grinder mid-span section is "too high"), the hydraulic jack's (23) retracts a predefined stroke (approaching to main structure (1) i.e. prestressing forces are reduced. This second strategy (b) is simpler to be applied than control strategy (a) and is not sensitive to local phenomena (where the sensor is located). This strategy may be mathematically stated through equations similar to equation 1.

This procedure can easily be generalized for gantries with more than one actuator. The planning of more robust strategies is made considering factors like the way the concrete filling is made, or the consideration of non-symmetric loadings e.g. bridge curve decks.

The control board is designed according to common techniques, attending to each case preferences or needs. It may be activated by means of pull buttons or by means of a digital interface. The control board is preferably located in the gantry (1) near the actuator and the hydraulic pump (20).

As will be evident to all those skilled in the field, the control of the system may also be done in a semi-automatic manner, in which a human operator replaces the automatic control unit. In this scenario, there would exist a simple electric board that would control the hydraulic circuit and hydraulic jacks, namely the intensity and direction of forces to be applied. The human operator would receive the readings of the sensors placed in the neighbourhood, surface, interior and/or external in relation to the main structure, interpret them and manually control which jack or jacks should take action, and also the direction and level of that action. This semi-automatic system is prone to more error than the fully automatic system described above, yet it provides another feasible embodiment of the invention.

In order for the gantry of the present invention to be easily moved, for example from one span to another, it is most important to attend to certain funcionality requirements. For this purpose, certain elements of the gantry that protrude extensively past the contours of the structure are designed to be movable, retractable or even removable. This is particularly important for the connecting struts (13), the deviation saddles (14) and cables (5). Several solutions may be designed to achieve this objective, depending on each launching caracterisctics. In one possible embodiment, the invention is provided with rotational struts that are positioned by secondary hydraulic jacks and whose rotational courses are restricted by structural fixed devices (See FIG. 10).

It is also foreseen that the main structure (1) be capable of being divided into several modular sections in order to adapt it to many spans of different lengths. This characteristic is common to many modern prior art gantries.

According to structural design features, reinforcements (12) may be assembled in the proximity of the area of the anchorages and the locations where the connecting struts (13) are connected to the main structure (1).

The deviation saddles may be designed with some sliding pieces (not illustrated) in the contact section with the cable or cables that provide tangent courses the latter and thus reduce eventual high friction forces in order to prevent fretting fatigue. Lubrificated wheels may be also used for that purpose.

A safety mechanical retention system may be also provided close to the actuator, where two adjustable nuts installed on two fixed struts accompany the piston's movement with a slight delay, thus preventing actuator retraction in case of failure of any hydraulic components.

In the hydraulic circuit of the actuators, some additional retention valves can be installed in between the directional valve and the piston thus avoiding prestressing losses. The system is also preferably equipped with alarms that detect security dangers. Aside from the alarms, emergency signals or messages can be sent to a control cabinet or even eventually to the mobile phones of engineers and operators on location. Furthermore, it is also preferable to design and install an Urgent Power Supply (UPS) system to assure the supply of power in the event of an energy blackout.

Depending on each case importance and involved risk, redundancy must be provided for most electronic components and for some elements of the hydraulic circuit.

Certain procedures are also advisable before loading the gantry in a real-life working situation, such as the performance of a series of preliminary and calibration tests. These tests identify certain mechanical and structural properties and conditions, as well as evaluate connections, elasticity of the cables, performance of the sensor or sensors and the functioning and precision of the actuator or actuators. The tests should be performed until the entire system is adequately tuned.

The invention claimed is:

1. A gantry for use in the construction process of bridges, viaducts and other structures, said gantry comprising:

an essentially elongated main structure;

at least one unbonded cable with one end secured to said main structure by a first anchorage and the opposite end of said unbonded cable secured to a different location on said main structure by a second anchorage;

an actuator resting permanently between said main structure and said unbonded cable;

at least one sensor unit capable of noting measurements of physical variations on said main structure and communicating said measurements to an electronic interface which converts them into readable data accepted by a controller that controls the extension of said actuator, such that said actuator extends or retracts in order to increase or decrease, respectively, the tension of said unbonded cable in accordance with an increase or decrease of the loading or internal forces present on said main structure.

2. A gantry according to claim 1 wherein said controller controls the intensity and direction of the force applied by said actuator on said unbonded cable.

3. A gantry according to claim 1, wherein said unbonded cable is internal or external to the contours of said main structure.

4. A gantry according to claim 1, wherein said unbonded cable has a linear or multi-linear layout.

5. A gantry according to claim 1, wherein said actuator is at least one extendable strut with a first end removably connected to a saddle in contact with said unbonded cable and a second end removably connected to said main structure.

6. A gantry according to claim 5, wherein said strut is retractable or movable, by translation or rotation.

7. A gantry according to claim 1, wherein said gantry provides support for formwork (in situ casting structures) or for precast segments, precast girders, or even for other material structural elements.

8. A method for providing a pre-existing gantry with a self-adjusting prestressing system, wherein said pre-existing gantry is equipped with the elements of claim 1.

9. A gantry according to claim 1, wherein said actuator is capable of dislodging said first or said second anchorage towards or away from said main structure so as to respectively decrease or increase the tension of said unbonded cable.

* * * * *